US009719345B2

(12) United States Patent
Switzer et al.

(10) Patent No.: US 9,719,345 B2
(45) Date of Patent: Aug. 1, 2017

(54) ELECTROMAGNETIC COMMUNICATIONS SYSTEM AND METHOD FOR A DRILLING OPERATION

(71) Applicant: Evolution Engineering Inc., Calgary (CA)

(72) Inventors: David A. Switzer, Calgary (CA); Jili Liu, Calgary (CA); Mingdong Xu, Calgary (CA); Mojtaba Kazemi Miraki, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 14/779,903

(22) PCT Filed: Mar. 24, 2014

(86) PCT No.: PCT/CA2014/050305

§ 371 (c)(1),
(2) Date: Sep. 24, 2015

(87) PCT Pub. No.: WO2014/153657

PCT Pub. Date: Oct. 2, 2014

(65) Prior Publication Data

US 2016/0053610 A1 Feb. 25, 2016

Related U.S. Application Data

(60) Provisional application No. 61/806,217, filed on Mar. 28, 2013.

(51) Int. Cl.
*G01V 3/00* (2006.01)
*E21B 47/14* (2006.01)
(Continued)

(52) U.S. Cl.
CPC ..... *E21B 47/122* (2013.01)

(58) Field of Classification Search
CPC ..... E21B 47/122; E21B 47/12; G01V 11/002; H04L 27/3818; H04L 27/362
(Continued)

(56) References Cited

U.S. PATENT DOCUMENTS 4,087,781 A 5/1978 Grossi et al.
4,302,757 A 11/1981 Still
(Continued)

FOREIGN PATENT DOCUMENTS

GB 2 434 682 A 8/2007

*Primary Examiner* — Firmin Backer
*Assistant Examiner* — Jerold Murphy
(74) *Attorney, Agent, or Firm* — Seed Intellectual Property Law Group LLP

(57) ABSTRACT

A wireless communications system for a downhole drilling operation comprises surface communications equipment and a downhole telemetry tool. The surface communications equipment comprises a surface EM communications module with an EM downlink transmitter configured to transmit an EM downlink transmission at a frequency between 0.01 Hz and 0.1 Hz. The downhole telemetry tool is mountable to a drill string and has a downhole electromagnetic (EM) communications unit with an EM downlink receiver configured to receive the EM downlink transmission. The downhole EM communications unit can further comprise an EM uplink transmitter configured to transmit an EM uplink transmission at a frequency greater than 0.5 Hz, in which case the surface EM communications module further comprises an EM uplink receiver configured to receive the EM uplink transmission. More particularly, the downhole EM uplink transmitter can be configured to transmit the EM uplink transmission at a frequency that is at least ten times higher than the EM downlink transmission frequency.

23 Claims, 15 Drawing Sheets

(51) Int. Cl.

| | |
|---|---|
| ***E21B 47/16*** | (2006.01) |
| ***G01V 1/40*** | (2006.01) |
| ***E21B 47/12*** | (2012.01) |

(58) Field of Classification Search
USPC ..... 340/854.6, 870.1; 367/81
See application file for complete search history.

(56) References Cited

U.S. PATENT DOCUMENTS

| | | | | |
|---|---|---|---|---|
| 7,495,446 | B2 | 2/2009 | Lovell et al. | |
| 7,539,279 | B2 * | 5/2009 | Lu | G01V 3/083 181/101 |
| 8,251,160 | B2 | 8/2012 | Gopalan et al. | |
| 2005/0046589 | A1 * | 3/2005 | Wisler | E21B 17/003 340/854.6 |
| 2007/0247328 | A1 * | 10/2007 | Petrovic | G01V 11/002 340/853.7 |
| 2011/0132607 | A1 | 6/2011 | Lahitette et al. | |
| 2013/0293387 | A1 * | 11/2013 | Short | E21B 33/037 340/854.6 |

* cited by examiner

ELECTROMAGNETIC COMMUNICATIONS SYSTEM AND METHOD FOR A DRILLING OPERATION

FIELD

This invention relates generally to an electromagnetic (EM) communications system and method for a drilling operation.

BACKGROUND ART

The recovery of hydrocarbons from subterranean zones relies on the process of drilling wellbores. The process includes using drilling equipment situated at the surface, and a drill string extending from the equipment on the surface to a subterranean zone of interest such as a formation. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to the surface carrying rock cuttings produced by the drilling operation. The mud also helps control bottom hole pressure and prevent hydrocarbon influx from the formation into the wellbore, which can potentially cause a blow out at the surface.

Directional drilling is the process of steering a well from vertical to intersect a target endpoint or follow a prescribed path. At the terminal end of the drill string is a bottom-hole-assembly ("BHA") that includes 1) the drill bit; 2) a steerable downhole mud motor; 3) sensors of survey equipment used in logging-while-drilling ("LWD") and/or measurement-while-drilling ("MWD") to evaluate downhole conditions as drilling progresses; 4) telemetry equipment for transmitting data to the surface; and 5) other control equipment such as stabilizers or heavy weight drill collars. The BHA is conveyed into the wellbore by a string of metallic tubulars known as drill pipe. The MWD equipment is used to provide in a near real-time mode downhole sensor and status information to the surface while drilling. This information is used by a rig operator to make decisions about controlling and steering the drill string to optimize the drilling speed and trajectory based on numerous factors, including lease boundaries, existing wells, formation properties, and hydrocarbon size and location. The operator can make intentional deviations from the planned wellbore path as necessary based on the information gathered from the downhole sensors during the drilling process. The ability to obtain real-time MWD data allows for a relatively more economical and more efficient drilling operation.

A drill string can comprise a downhole telemetry tool that contains a MWD sensor package to survey the well bore and surrounding formation, as well as telemetry transmitting means for sending telemetry signals to the surface, i.e. "uplinking". Such uplinking telemetry means include acoustic telemetry, fibre optic cable, mud pulse (MP) telemetry and electromagnetic (EM) telemetry.

EM telemetry involves the generation of electromagnetic waves which travel through the earth's surrounding formations around the wellbore and to the surface. In EM telemetry systems, an alternating current is driven across a gap sub which comprises an electrically isolated joint, effectively creating an insulating break ("gap") between the upper and lower portions of the drill string. An EM telemetry signal comprising a low frequency AC voltage is controlled in a timed/coded sequence to energize the earth and create a measureable voltage differential between the surface ground and the top of the drill string. The EM signal which originated across the gap is detected at the surface and measured as a difference in the electric potential from the drill rig to various surface grounding rods located about the drill site.

During a drilling operation, a drill operator can communicate with the downhole equipment by transmitting telemetry transmission from a surface transmitter to a downhole receiver in the downhole equipment. This operation is known as "downlinking" from surface and allows commands from the surface to be communicated to the BHA assembly. Various downlinking transmission means have been proposed, including transmission by EM. Downlinking by EM does present certain challenges. For example, EM downlinking, while advantageously not requiring mud flow to operate, can be significantly attenuated as EM signals travel through the Earth's formation, and high power is typically employed to ensure that EM signals reach a BHA that is far downstring. Providing a suitably powerful current source at the surface can present safety challenges, especially as the drill site can be a hazardous gas environment.

SUMMARY

According to one aspect of the invention, there is provided a wireless communications system for a downhole drilling operation comprising surface communications equipment and a downhole telemetry tool. The surface communications equipment comprises a surface EM communications module with an EM downlink transmitter configured to transmit an EM downlink transmission at a frequency between 0.01 Hz and 0.1 Hz. The downhole telemetry tool is mountable to a drill string and has a downhole electromagnetic (EM) communications unit with an EM downlink receiver configured to receive the EM downlink transmission. The downhole EM communications unit can further comprise an EM uplink transmitter configured to transmit an EM uplink transmission at a frequency greater than the EM downlink transmission, such as 0.5 Hz, in which case the surface EM communications module further comprises an EM uplink receiver configured to receive the EM uplink transmission. More particularly, the downhole EM uplink transmitter can be configured to transmit the EM uplink transmission at a frequency that is at least ten times higher than the EM downlink transmission frequency.

The surface EM downlink transmitter can be configured to transmit the EM downlink transmission at a voltage and current that is below ignition energies for hazardous gases at the drilling operation. More particularly, the voltage and current of the EM downlink transmission can be within an intrinsically safe zone for a hazardous gas environment.

The surface EM downlink transmitter subassembly can be configured to generate the EM downlink transmission in the form of a square wave signal, or a pulsed signal, or a sinusoidal carrier wave signal.

Alternatively, the surface EM downlink transmitter can be configured to generate the EM downlink transmission in the form of chirp signal, in which case the surface processing equipment can further comprise a computer having a processor with a memory having encoded thereon an EM signal modulation program code executable by the processor to encode a downlink message into the chirp signal. The EM signal modulation program code can comprise a binary symbol set wherein a first bit is represented by an up-chirp and a second bit is represented by a down-chirp. Alternatively, the EM signal modulation program code can comprise a binary symbol set wherein a first bit is represented by a fast-slow-fast chirp a second bit is represented by a slow-fast-slow chirp. As another alternative, the EM signal modulation program code can comprise a three or five bit symbol set wherein each symbol comprises a group of the first and second bits.

The EM downlink transmission can contain an encoded downlink message having a structure comprising in sequential order: a fixed header, a pause, and a data packet. The data packet can comprise a data ID containing a type of change to make in the downhole telemetry tool, message content containing settings for the type of change, and error and correction bits. The data packet can contain a confirmation requested flag command, in which case the downhole telemetry tool comprises a processor and a memory having encoded thereon program code executable by the processor to decode the EM downlink transmission and transmit an EM uplink transmission comprising a confirmation message when the decoded EM downlink transmission contains the confirmation requested flag command. The confirmation message can comprise the entire downlink message.

According to another aspect, there is provided a method for communicating between surface communications equipment and a downhole telemetry tool in a downhole drilling operation, comprising: transmitting an EM downlink transmission at a frequency between 0.01 Hz and 0.1 Hz using a surface EM communications module with an EM downlink transmitter; and configuring a downhole electromagnetic (EM) communications unit with an EM downlink receiver to receive the EM downlink transmission at the transmitted frequency. The EM communications module is part of the surface communications equipment and the downhole EM communications unit is part of the downhole telemetry tool which is mounted to a drill string. The EM downlink transmission can be in the form of a square wave signal, or a pulsed signal, or a sinusoidal carrier wave signal.

The method can further comprise transmitting an EM uplink transmission at a frequency that is higher than the EM downlink transmission frequency, using an EM uplink transmitter of the downhole EM communications unit; and configuring an EM uplink receiver of the surface EM communications module to receive the EM uplink transmission at the transmitted frequency. The EM uplink transmission can be transmitted at a frequency greater than 0.5 Hz. More particularly, the EM uplink transmission can be transmitted at a frequency that is at least ten times higher than the EM downlink transmission frequency.

The method can further comprise transmitting the EM downlink transmission at a voltage and current that is below ignition energies for hazardous gases at the drilling operation.

BRIEF DESCRIPTION OF FIGURES

FIGS. 13(*c*) and 13(*d*) are respective graphs of three bit and a five bit symbols encoded as groups of the first and second chirp waveforms.

DETAILED DESCRIPTION

Overview

Embodiments of the present invention described herein relate to a wireless communications system for downhole drilling operations comprising surface communications equipment that includes a surface EM communications module, and a downhole telemetry tool on a drill string and comprising a downhole EM communications unit. The downhole telemetry tool can be configured to collect MWD telemetry data and transmit this telemetry and other data to the surface communications equipment ("uplink transmission") using an EM uplink transmitter of the downhole EM communications unit. The surface EM communications module includes an EM uplink receiver for receiving uplink transmissions, and an EM downlink transmitter for sending instructions and other information to the downhole telemetry tool ("downlink transmission"). Downlink transmissions can be transmitted at an ultra low frequency and at a frequency that is sufficiently different from the frequency of the uplink transmission to substantially avoid signal interference between the transmissions. The downlink transmission is also transmitted at a selected voltage and current that are within a selected safety threshold to minimize explosion risk around a drill site; the selected safety threshold can be a threshold that meets regulatory guidelines that define an intrinsically safe operation in a hazardous gas environment.

Figure 1:
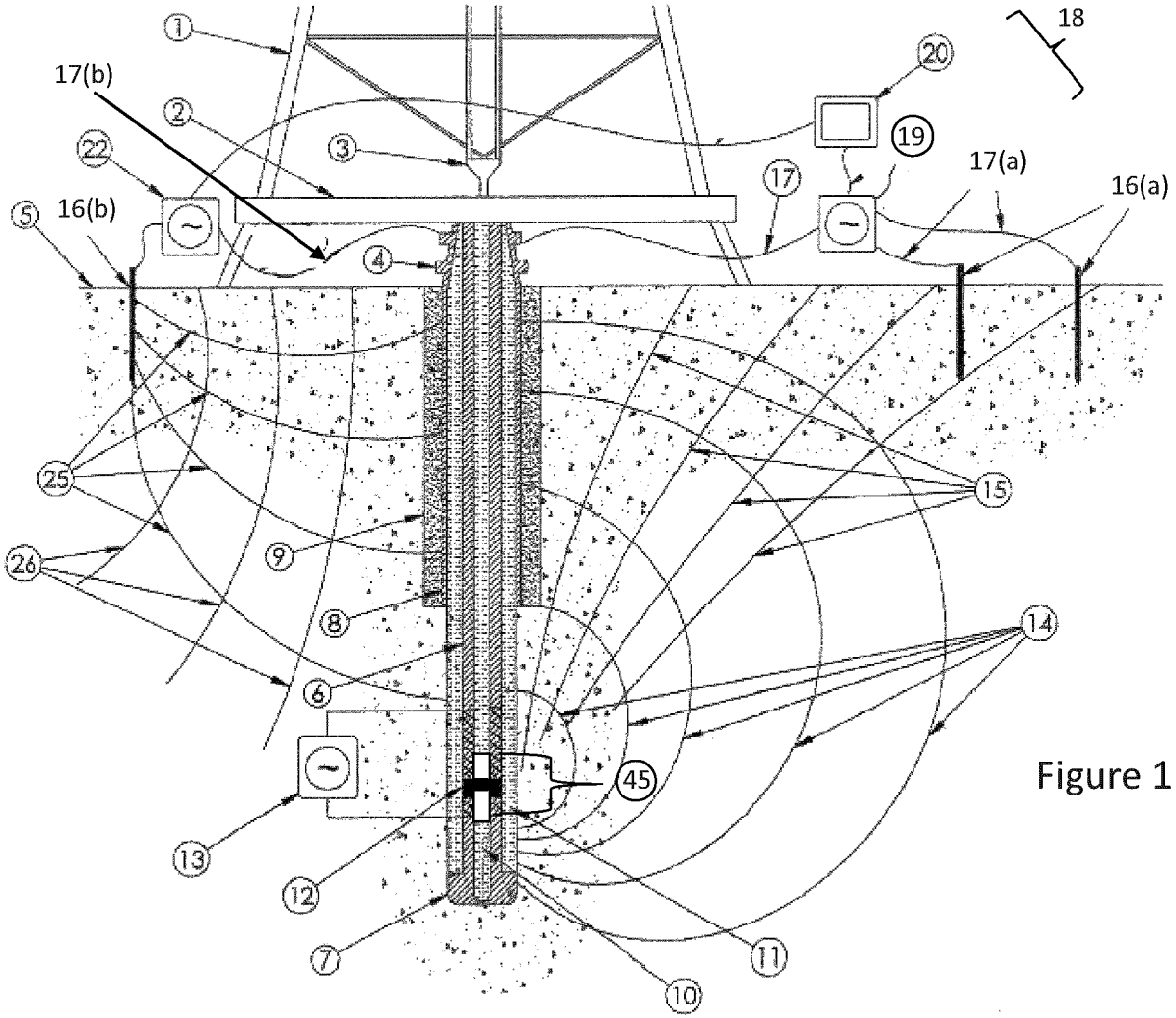
FIG. 1 is a schematic side view of a wireless communications system in operation at a drill site, according to a first embodiment of the invention.

Referring to FIG. 1, there is shown a schematic representation of a downhole drilling operation in which a first embodiment of the present invention can be employed. Downhole drilling equipment including a derrick 1 with a rig floor 2 and draw works 3 facilitates rotation of drill pipe 6 into the ground 5. The drill pipe 6 is enclosed in casing 8 which is fixed in position by casing cement 9. Bore drilling fluid 10 is pumped down the drill pipe 6 and through an electrically isolating gap sub assembly 12 by a mud pump (not shown) to a drill bit 7. Annular drilling fluid 11 is then pumped back to the surface and passes through a blow out preventer ("BOP") 4 positioned above the ground surface. The gap sub assembly 12 is electrically isolated (nonconductive) at its center joint effectively creating an electrically insulating break, known as a gap between the top and bottom parts of the gap sub assembly 12. The gap sub assembly 12 may form part of the BHA and be positioned at the top part of the BHA, with the rest of the BHA below the gap sub assembly 12 and the drill pipe 6 above the gap sub assembly 12 each forming an antennae for a dipole antennae.

The wireless communication system comprises surface communications equipment 18 and a downhole telemetry tool 45 attached to the drill pipe 6. The surface communications equipment 18 and the downhole telemetry tool 45 communicate wirelessly with each other via EM downlink and uplink transmissions. The downhole telemetry tool 45 comprises a downhole EM communications unit 13 having an EM uplink transmitter which generates an alternating electrical current 14 that is driven across the gap sub assembly 12 to generate carrier waves or pulses which carry encoded telemetry and/or other data to the surface ("EM uplink transmission"). The low frequency AC voltage and magnetic reception is controlled in a timed/coded sequence by the telemetry tool 45 to energize the earth and create an electrical field 15, which propagates to the surface. The telemetry tool 45 also includes an EM downlink receiver which forms part of the downhole EM communications unit 13.

At the surface, the surface communications equipment 18 includes equipment to receive and transmit EM signals. More particularly, the surface communications equipment 18 includes a surface EM communications module comprising an EM uplink receiver comprising uplink grounding rods 16(*a*) located around the drill site, communication cables 17(*a*) coupled to the grounding rods 16(*a*) and the top of the drill string, and an uplink receiver circuitry 19 coupled to the communication cables 17(*a*). To detect EM telemetry transmissions, a measurable voltage differential from the top of the drill string and the uplink grounding rods 16(*a*) is transmitted via the communication cables 17(*a*) to the uplink receiver circuitry 19 for signal processing and then to a computer 20 for decoding and display, thereby providing EM measurement-while-drilling information to the rig operator. The surface EM communications module also comprises an EM downlink transmitter comprising a downlink grounding rod 16(*b*), communications cables 17(*b*) coupled to the downlink grounding rod 16(*b*) and top of the drill string, and an EM downlink transmitter 22 coupled to the communication cable 17(*b*) and to the computer 20. The computer 20 encodes instructions and other information into a communications signal and the EM downlink transmitter 22 generates an EM carrier wave 25 representing this communications signal which is then transmitted into the ground 5 by the downlink grounding rods 16(*b*) ("EM downlink transmission").

Preferably, the downlink grounding rod 16(*b*) is located separately from the uplink grounding rods 16(*a*); however, the type and geometry of wellbore (vertical or horizontal) will dictate the placement of the grounding rods 16(*a*), 16(*b*) to some extent.

As will be discussed in further detail below, the uplink and downlink grounding rods 16(*a*), 16(*b*) are configured to receive and transmit EM signals at different frequencies to minimize interference with each other.

Downhole Telemetry Tool

Figure 2:
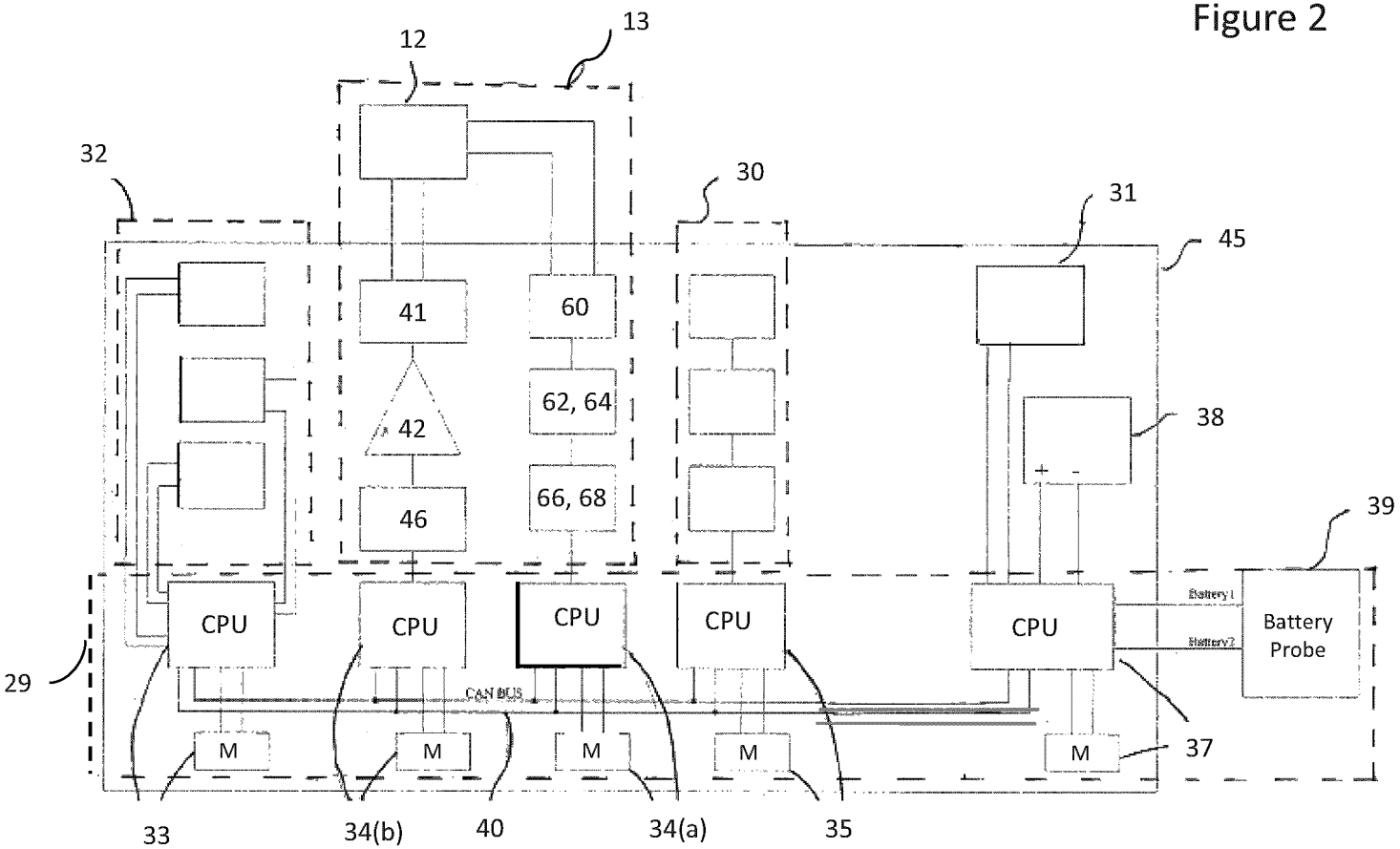
FIG. 2 is a schematic block diagram of components of a downhole telemetry tool of the first embodiment of the wireless communications system comprising an EM communications unit.

Referring now to FIG. 2, the downhole telemetry tool 45 generally comprises the EM communications unit 13, sensors 30, 31, 32 and an electronics subassembly 29. The electronics subassembly 29 comprises one or more processors and corresponding memories which contain program code executable by the corresponding processors to encode sensor measurements into telemetry data and send control signals to the EM communications unit 13 to transmit EM telemetry signals to the surface.

The sensors include directional and inclination (D&I) sensors 30; a pressure sensor 31, and drilling conditions sensors 32. The D&I sensors 30 comprise three axis accelerometers, three axis magnetometers, a gamma module, back-up sensors, and associated data acquisition and processing circuitry. Such D&I sensors 30 are well known in the art and thus are not described in detail here. The drilling conditions sensors 32 include sensors for taking measurements of borehole parameters and conditions including shock, vibration, RPM, and drilling fluid (mud) flow, such as axial and lateral shock sensors, RPM gyro sensors and a flow switch sensor. The pressure sensor 31 is configured to measure the pressure of the drilling fluid outside the telemetry tool 45. Such sensors 31, 32 are also well known in the art and thus are not described in detail here.

The telemetry tool 45 can feature a single processor and memory module ("master processing unit"), or several processor and memory modules. The processors can be any suitable processor known in the art for MWD telemetry tools, and can be for example, a dsPIC33 series MPU. In this embodiment, the telemetry tool 45 comprises multiple processors and associated memories, namely: a control sensor CPU and corresponding memory ("control sensor control module") 33 communicative with the drilling conditions sensors 32, an EM downlink receiver CPU and corresponding memory ("EM downlink control module") 34(*a*) in communication with the EM communications unit 13, an EM signal generator CPU and corresponding memory ("EM uplink control module") 34(*b*) also in communication with the EM communications unit 13, an interface and backup CPU and corresponding memory ("interface control module") 35 in communication with the D&I sensors 30, and a power management CPU and corresponding memory ("power management control module") 37 in communication with the pressure sensor 31.

The telemetry tool 45 also comprises a capacitor bank 38 for providing current during high loads, batteries 39 which are electrically coupled to the power management control module 37 and provide power to the telemetry tool 45, and a CANBUS communications bus 40. The control modules 33, 34, 35, 37 are each communicative with the communications bus 40, which allows data to be communicated between the control modules 33, 34, 35, 37, and which allows the batteries 39 to power the control modules 33, 34, 35, 37 and the connected sensors 30, 31, 32 and EM communication unit 13. This enables the EM uplink control module 34(*b*) to independently read measurement data from the sensors 30, 32.

The control sensor control module 33 contains program code stored in its memory and executable by its CPU to read drilling fluid flow measurements from the drilling conditions sensors 32 and determine whether mud is flowing through the drill string, and transmit a "flow on" or a "flow off" state signal over the communications bus 40. The memory of the control sensor control module 33 also includes executable program code for reading gyroscopic measurements from the drilling conditions sensors 32 and to determine drill string RPM and whether the drill string is in a sliding or rotating state, and then transmit a "sliding" or "rotating" state signal over the communications bus 40. The memory of the control sensor control module 33 further comprises executable program code for reading shock measurements from shock sensors of the drilling conditions sensors 32 and send out shock level data when requested by one or both of the EM controller modules 34(*a*), 34(*b*).

The interface control module 35 contains program code stored in its memory and executable by its CPU to read D&I and gamma measurements from the D&I sensors 30, determine the D&I of the BHA and send this information over the communications bus 40 to the EM control module 34 when requested.

The power management control module 37 contains program code stored in its memory and executable by its CPU to manage the power usage by the telemetry tool 45. The power management module 37 can contain further program code that when executed reads pressure measurements from the pressure sensor 31, determines if the pressure measurements are below a predefined safety limit, and electrically disconnects the batteries 39 from the rest of the telemetry tool 45 until the readings are above the safety limit.

The sensors 30, 31, 32, and electronics subassembly 29 can be mounted to a main circuit board and located inside a tubular housing (not shown). Alternatively, some of the sensors 30, 31, 32 such as the pressure sensor 31 can be located elsewhere in the telemetry tool 45 and be communicative with the rest of the electronics subassembly 29. The main circuit board also contains the communications bus 40 and can be a printed circuit board with the control modules 33, 34, 35, 37 and other electronic components soldered on the surface of the board. The main circuit board and the sensors 30, 31, 32 and control modules 33, 34, 35, 37 are secured on a carrier device (not shown) which is fixed inside the housing by end cap structures (not shown).

The memory of the EM uplink control module 34(*b*) contains encoder program code that is executed by the associated CPU 34(*b*) to perform a method of encoding measurement data into an EM telemetry signal that can be transmitted by the EM communications unit 13 using EM carrier waves or pulses to represent bits of data. The encoder program codes each utilize one or more modulation techniques that uses principles of known digital modulation techniques. For example, the EM encoder program can utilize a modulation technique such as amplitude shift keying (ASK), frequency shift keying (FSK), phase shift keying (PSK), or a combination thereof such as amplitude and phase shift keying (APSK) to encode telemetry data into a telemetry signal comprising EM carrier waves. ASK involves assigning each symbol of a defined symbol set to a unique pulse amplitude. TSK involves assigning each symbol of a defined symbol set to a unique timing position in a time period.

Figure 3:
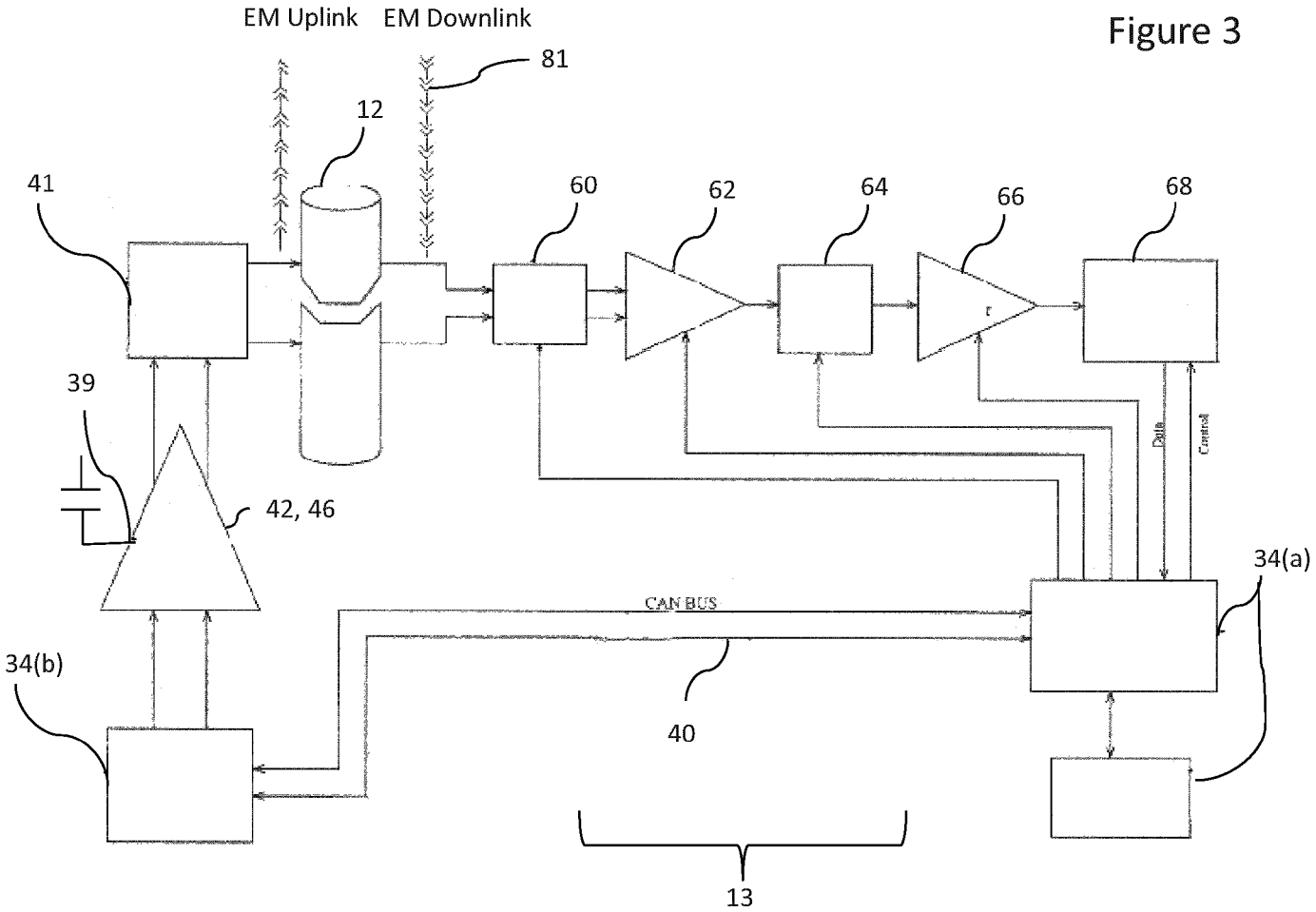
FIG. 3 is a schematic diagram of an EM signal generator of the EM communications unit.

Referring now to FIG. 3, the downhole EM communications unit 13 is configured to generate EM uplink transmissions that carry the telemetry and/or other data encoded by the modulation techniques discussed above. The EM communications unit 13 comprises an H-bridge circuit 41, a power amplifier 42, and an EM signal generator 46 (collectively referred to as the EM uplink transmitter of the downhole EM communications unit 13). As is well known in the art, an H-bridge circuit enables a voltage to be applied across a load in either direction, and comprises four switches of which one pair of switches can be closed to allow a voltage to be applied in one direction ("positive pathway"), and another pair of switches can be closed to allow a voltage to be applied in a reverse direction ("negative pathway"). In the H-bridge circuit 41 of the EM signal generator, switches S1, S2, S3, S4 (not shown) are arranged so that the part of the circuit with switches S1 and S4 is electrically coupled to one side of the gap sub 12 ("positive side"), and the part of the circuit with switches S2 and S3 are electrically coupled to the other side of the gap sub 12 ("negative side"). Switches S1 and S3 can be closed to allow a voltage to be applied across the positive pathway of the gap sub 12 to generate a positive carrier wave, and switches S2 and S4 can be closed to allow a voltage to applied across the negative pathway of the gap sub 12 to generate a negative carrier wave.

The signal generator 46 is communicative with the EM uplink control module 34(*b*) and the amplifier 42, and serves to receive the encoded telemetry signal from the EM uplink control module 34(*b*), and then translate the telemetry signal into an alternating current control signal which is then sent to the amplifier 42. The amplifier 42 is communicative with the signal generator 46, the batteries 39, and the H-bridge circuit 41 and serves to amplify the control signal received from the signal generator 46 using power from the batteries 39 and then send the amplified control signals to the H-bridge circuit 41 to generate the EM uplink transmission across the gap sub assembly 12.

The EM communications unit 13 is also configured to receive downlink transmissions and transmit these received transmissions to the EM downlink control module 34(*a*) for decoding into commands for execution by the other control modules 33, 34(*b*), 37 in the telemetry tool 45. The EM communications unit 13 further comprises a band pass filter 60 electrically coupled to each side of the gap sub 12, a pre-amplifier 62 electrically coupled to the band-pass filter 60, a low-pass filter 64 electrically coupled to the pre-amplifier 62, an amplifier 66 electrically coupled to the low-pass filter 64, and an A/D converter 68 electrically coupled to the amplifier 66 (collectively referred to as the EM downlink receiver of the downhole EM communications unit 13). The downlink control module 34(*a*) is communicative with each component 60, 62, 64, 66, 68 of the EM downlink receiver to control operation of each component 60, 62, 64, 66, 68 as well as to receive a downlink transmission 81 that has been filtered, amplified and digitized. As will be discussed below, the downlink control module 34(*a*) comprises a processor and memory having encoded thereon decoder program code executable by the processor to decode the downlink transmission 81 into instructions that are transmitted via the communications bus 40 to the other control modules 33, 34(*b*), 35, 37 for executing one or more configuration files stored in those control modules.

Figure 4:
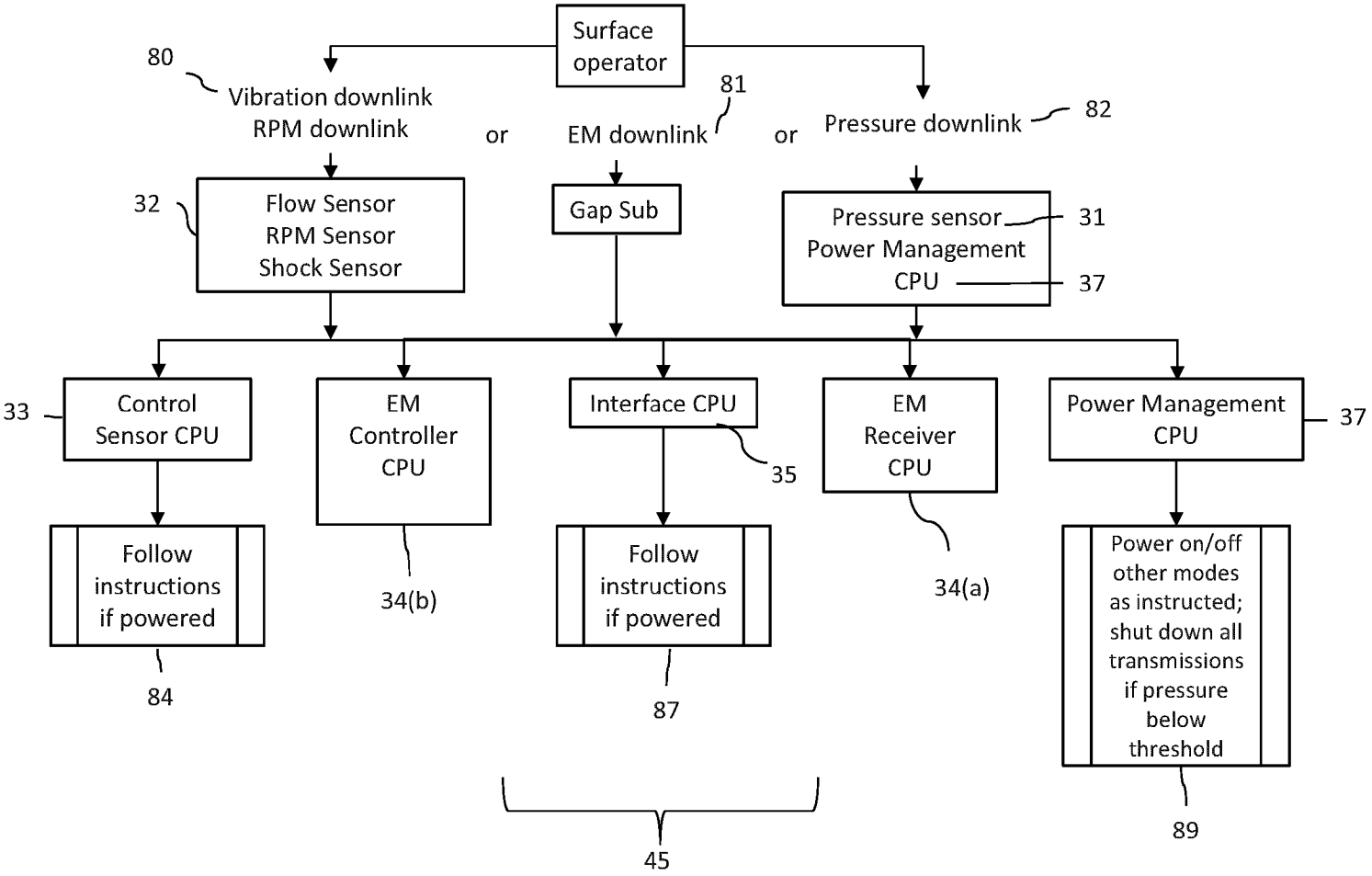
FIG. 4 is a block diagram of a plurality of processors of the downhole telemetry tool and their respective operations that are carried out in response to a downlink command.
Figure 5:
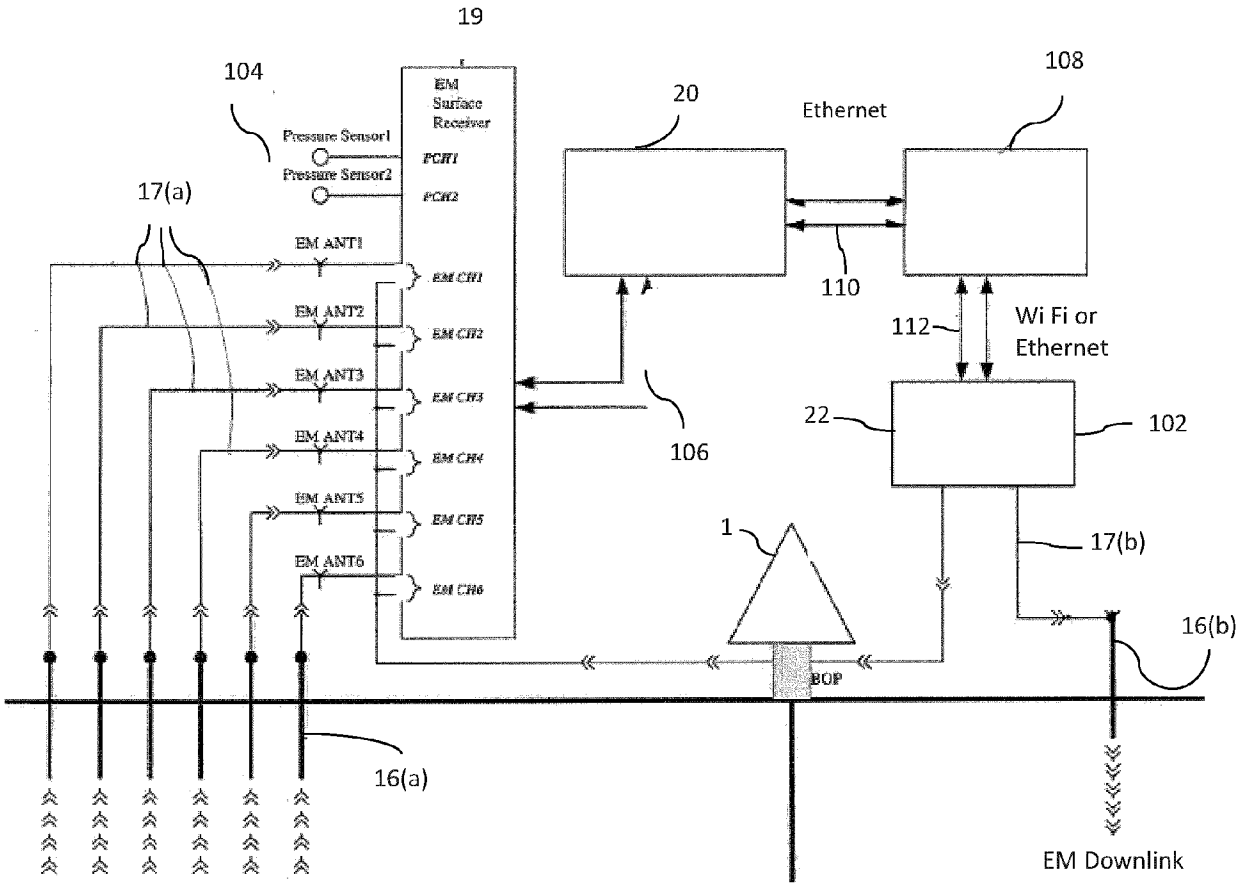
FIG. 5 is a schematic diagram of surface communications equipment of the wireless communications system, including a surface EM communications module.

Referring now to FIG. 4, the telemetry tool 45 contains a set of configuration files which are executable by one or more of the control modules 33, 34(*a*), 34(*b*), 35, 37 to operate the telemetry tool 45 to generate telemetry signals according to a selected operating configuration specified by instructions in the configuration file. The instructions will include the telemetry mode in which the telemetry tool 45 will operate, the type of message frames to be sent in the telemetry transmission, a composition of the message frame including the data type, timing and order of the data in each message frame, and a modulation scheme used to encode the data into a telemetry signal.

The downhole telemetry tool 45 is programmed to change its operating configuration when the downhole telemetry tool 45 receives a downlink transmission containing command instructions to execute a particular configuration file. The surface operator can send the downlink command by EM in the form of the EM downlink command 81, which is received and processed by the EM communications unit 13 and decoded by the EM downlink control module 34(*a*).

More particularly, the EM downlink control module 34(*a*) will execute decoder program code containing a demodulation technique(s) corresponding to the selected modulation technique(s) used by the surface operator to encode the instructions into the EM downlink transmission. The decoder program code uses this demodulation technique to decode the EM downlink transmission telemetry signals and extract the bitstream containing the command instructions. The EM downlink control module 34(*a*) will then read the command instructions and execute the configuration file portion stored on its memory corresponding to the configuration file specified in the command instructions, as well as forward the command instructions to the other control modules 33, 34(*b*), 35, 37 via the communications bus 40. Upon receipt of the downlink command instructions, the CPUs of the other control modules 33, 34(*b*), 35, 37 will also execute the configuration file portions in their respective memories that correspond to the configuration file specified in the downlink command. In particular, the control sensor control module 33 will operate its sensors 32 when instructed to do so in the configuration file (step 84); the interface control module 35 will operate its sensors when instructed to do so in its configuration file portion (step 87); and the power management control module 37 will power on or power off the other control modules 33-35 as instructed in its confirmation file portion, and will otherwise operate to manage power usage in the telemetry tool 45 and shut down operation when a measured pressure is below a specified safety threshold (step 89).

The surface operator can send downlink commands by vibration downlink 80, RPM downlink 80 or pressure downlink 82 in a manner as is known in the art. Flow and RPM sensors of the drilling conditions sensors 32 can receive the vibration downlink 80 or RPM downlink 80 commands; the pressure sensor 31 can receive the pressure downlink 82 command. Upon receipt of a downlink transmission, the CPU of the control sensor control module 33 or power management control module 37 will decode the received downlink transmission and extract the bitstream containing the downlink command instructions, in a manner similar to that of the EM downlink control module 34(*a*).

Surface Communications Equipment

Referring now to FIGS. 5 to 8, the surface communications equipment 18 comprises the surface EM communications module comprising the EM uplink receiver 19 and the EM downlink transmitter 22. The downlink transmitter and uplink receiver 19, 22 are communicative with the computer 20 which decodes EM uplink transmissions to recover the telemetry and other data for use by the operator and which encodes instructions and other information into the EM downlink transmission.

The EM uplink receiver 19 detects and processes EM uplink transmissions from the downhole telemetry tool 45, and sends these signals to the computer 20. The EM uplink receiver 19 comprises uplink receiver circuitry, which processes both EM uplink transmissions. The uplink receiver circuitry includes an EM receiver circuit and filters, a central processing unit (receiver CPU) and an analog to digital converter (ADC) (none shown). More particularly, the uplink receiver circuitry 19 comprises a surface receiver circuit board containing the EM receiver circuit and filters. The EM receiver circuit and filters comprises a preamplifier electrically coupled to the communication cables 17(*a*) to receive and amplify the EM uplink transmission comprising the EM carrier wave, and a band pass filter communicative with the preamplifier configured to filter out unwanted noise in the transmission. The ADC is also located on the circuit board and operates to convert the analog electrical signals received from the EM receiver and filters into digital data streams. The receiver CPU contains a digital signal processor (DSP) which applies various digital signal processing operations on the data streams by executing a digital signal processing program stored on its memory. Alternatively, separate hardware components can be used to perform one or more of the DSP functions; for example, an application-specific integrated circuit (ASIC) or field-programmable gate arrays (FPGA) can be used to perform the digital signal processing in a manner as is known in the art. Such preamplifiers, band pass filters, and A/D converters are well known in the art and thus are not described in detail here. For example, the preamplifier can be an INA118 model from Texas Instruments™, the ADC can be an ADS1282 model from Texas Instruments™, and the band pass filter can be an optical band pass filter or an RLC circuit configured to pass frequencies between 0.1 Hz to 20 Hz.

The computer 20 is communicative with the uplink receiver circuitry 19 via an Ethernet 106 or other suitable communications cable to receive the processed EM telemetry signals. The computer 20 in one embodiment is a general purpose computer comprising a central processing unit (CPU and herein referred to as "surface processor") and a memory having program code executable by the surface processor to perform various decoding functions including digital signal-to-telemetry data demodulation. The computer 20 can also include program code to perform digital signal filtering and digital signal processing in addition to or instead of the digital signal filtering and processing performed by the uplink receiver circuitry.

More particularly, the computer 20 includes executable decoder program code containing a demodulation technique(s) corresponding to the selected modulation technique(s) used by the downhole EM communications unit 13 which is used to decode the modulated telemetry signals. The computer 20 also contains the same set of configuration files that were downloaded onto the telemetry tool 45, and will refer to the specific configuration file used by the telemetry tool 45 to decode the received telemetry signals that were transmitted according to that configuration file. Specifically, the decoder program code utilizes a demodulation technique that corresponds specifically to the modulation technique used by the telemetry tool 45 to encode the measurement data into the EM uplink transmission.

Figure 6:
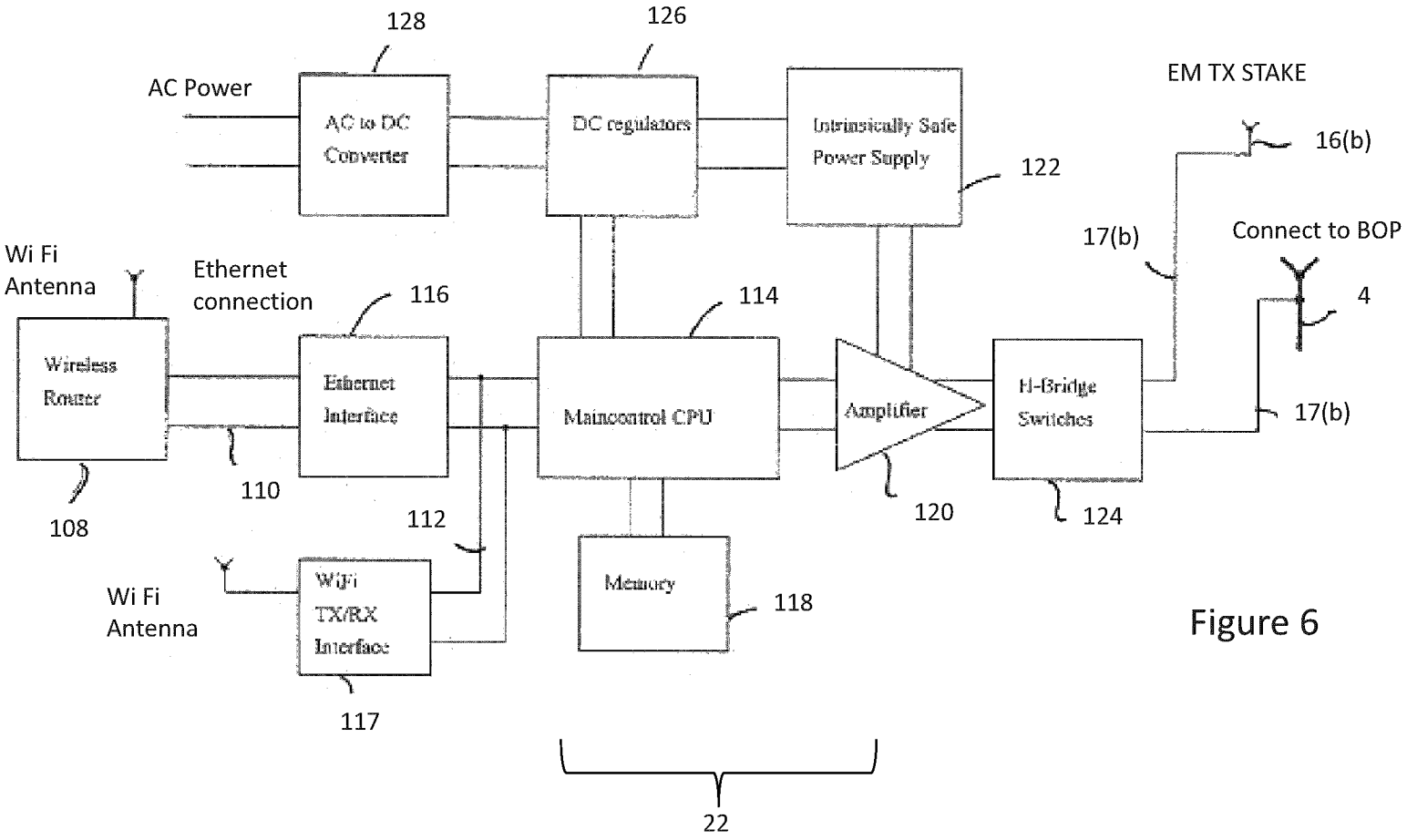
FIG. 6 is a schematic diagram of a downlink transmitter of the surface EM communications module.

The EM downlink transmitter 22 comprises the EM downlink transmitter circuitry 102 and a router 108 that is communicative with the computer 20 via Ethernet cable 110 and with the EM downlink transmitter circuitry 102 via Ethernet or WiFi 112. Referring particularly to FIG. 6, the EM downlink transmitter circuitry 22 comprises a main control CPU 114 which is communicatively coupled to an Ethernet interface 116 for communicating with the router 108 via the Ethernet cable 110, a WiFi interface 117 for communicating with the router 108 wirelessly, a memory 118 which stores encoder program code executable by the main control CPU 114 to encode instructions and other information into analog communication signals, and to an amplifier 120 which amplifies the analog communication signal to a suitable level for downlink transmission to the downhole telemetry tool 45. The amplifier 120 receives power from a power supply 122, and transmits the amplified communications signal to a H-bridge circuit 124 which is electrically coupled to the BOP 4 and downlink grounding rods 16(*b*) and functions similarly to the H-bridge circuit 41 of the downhole telemetry tool 45 to radiate the communication signals as an EM downlink transmission into the ground 5. In particular, the H-bridge circuit 124 has four switches so that positive and negative polarity currents are able to be generated.

The power supply 122 is electrically coupled to a DC regulator 126 which in turn is electrically coupled to an AC/DC converter 128. The AC/DC converter 128 receives AC power from a power source (not shown) and converts this into DC power, which is regulated by the DC regulator 126 for providing power to the main control CPU 114 and the amplifier 122.

Figure 7:
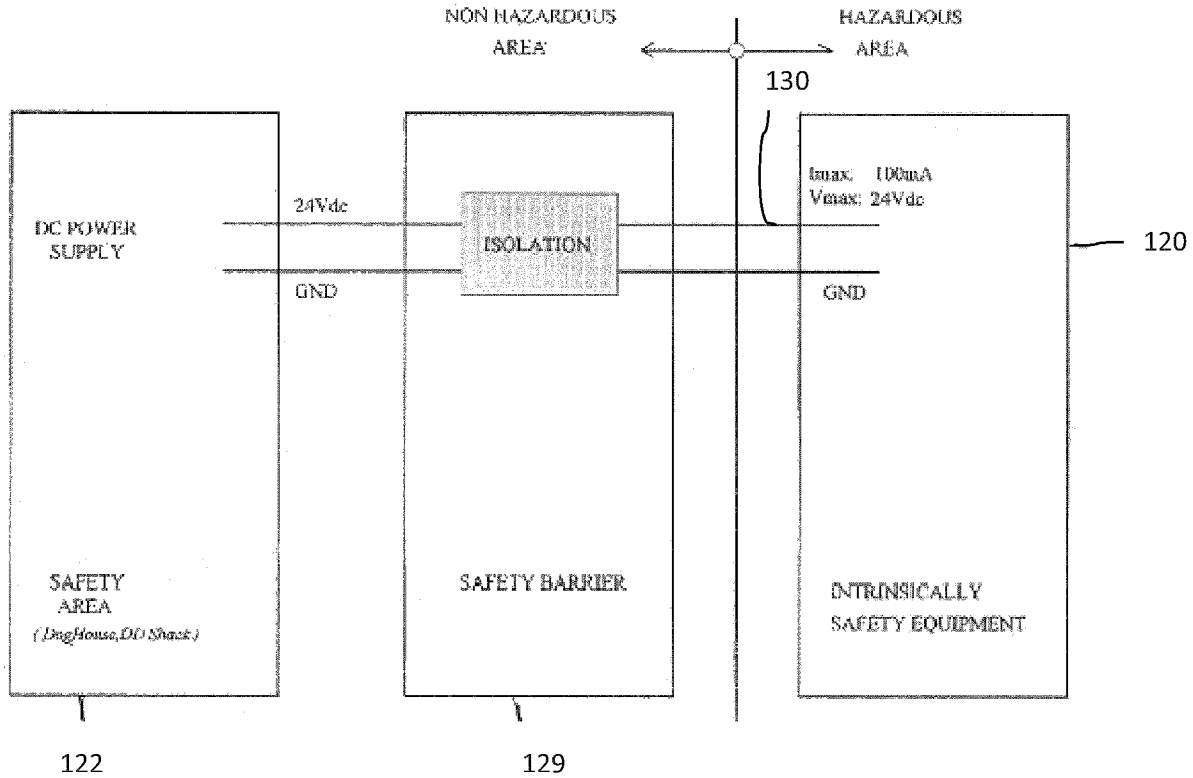
FIG. 7 is a schematic diagram of a power supply component of the EM downlink transmitter.
Figure 8:
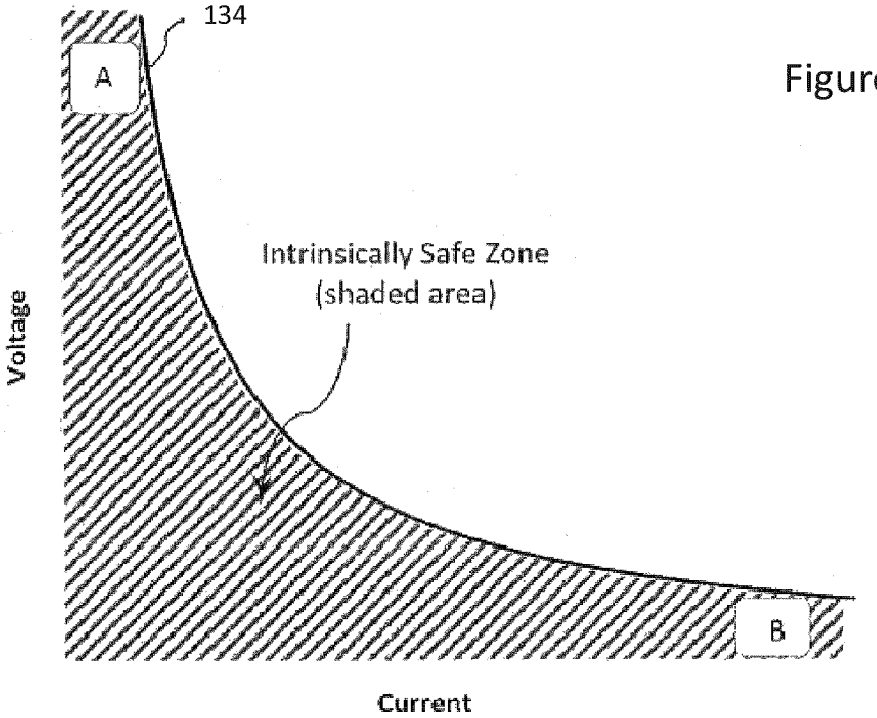
FIG. 8 is a graph of an intrinsically safe zone for operating voltage and current levels of the power supply.

Referring now to FIG. 7, the power supply 122 is located in a building (not shown) on the drill site, which is physically and electrically isolated by a safety barrier 129 from hazardous areas of the drill site that may contain gas content above an explosion threshold. The safety barrier 129 comprises a transformer, a transit protection Zener diode and current limitation resistors (not shown) to electrically isolate both sides 122, 120 of the hazardous and non-hazardous areas and limit the voltage and current from the non-hazardous to the hazardous areas. Power lines 130 electrically couple the power supply 122 to the amplifier 120. The power supply 122 is configured to transmit power via the power lines 130 at below a threshold that meets regulatory guidelines that define an intrinsically safe operation in a hazardous gas environment, such as UL913 in the United States and C22.2#157 in Canada. More particularly, and referring to FIG. 8, the power supply 122 is configured to transmit power to the amplifier 120 at a voltage and current that is within the intrinsically safe zone 136 bounded by the curve 134 shown in FIG. 8. This curve represents the known ignition energies for hazardous gases at the drill site.

It is expected that higher voltages will produce EM transmissions with higher signal strength and thus are more desirable for the EM downlink transmissions. Due to certain physical restrictions of the drill site and the requirement to select a voltage and current within the intrinsically safe zone 136, there are practical limits on the selectable voltage levels of the EM downlink transmission. In particular, the impedance of the EM downlink transmission is a function of the distance between the downlink grounding rod 16(*b*) and the BOP 4; to maximize impedance and allow for operation at the maximum possible voltage, the downlink grounding rod 16(*b*) is placed as far away as possible from the BOP 4. One intrinsically safe output of the power supply 120 is 24 V at 100 mA.

Signal Configuration

An operator will send command instructions or other information ("downlink message") to the downhole telemetry tool 45 via the user interface of the computer 20. As noted above, downlink messages are encoded by the computer using known modulation techniques into an analog EM signal, and this signal is amplified by the EM downlink transmitter circuitry 22 and transmitted through the ground via the downlink grounding rod 16(*b*); the EM downlink transmitter circuitry 22 is programmed to transmit a very low frequency EM signal of less than or equal 0.1 Hz. Such a frequency range is considered in the industry to be in the ultra low frequency range.

Figure 9:
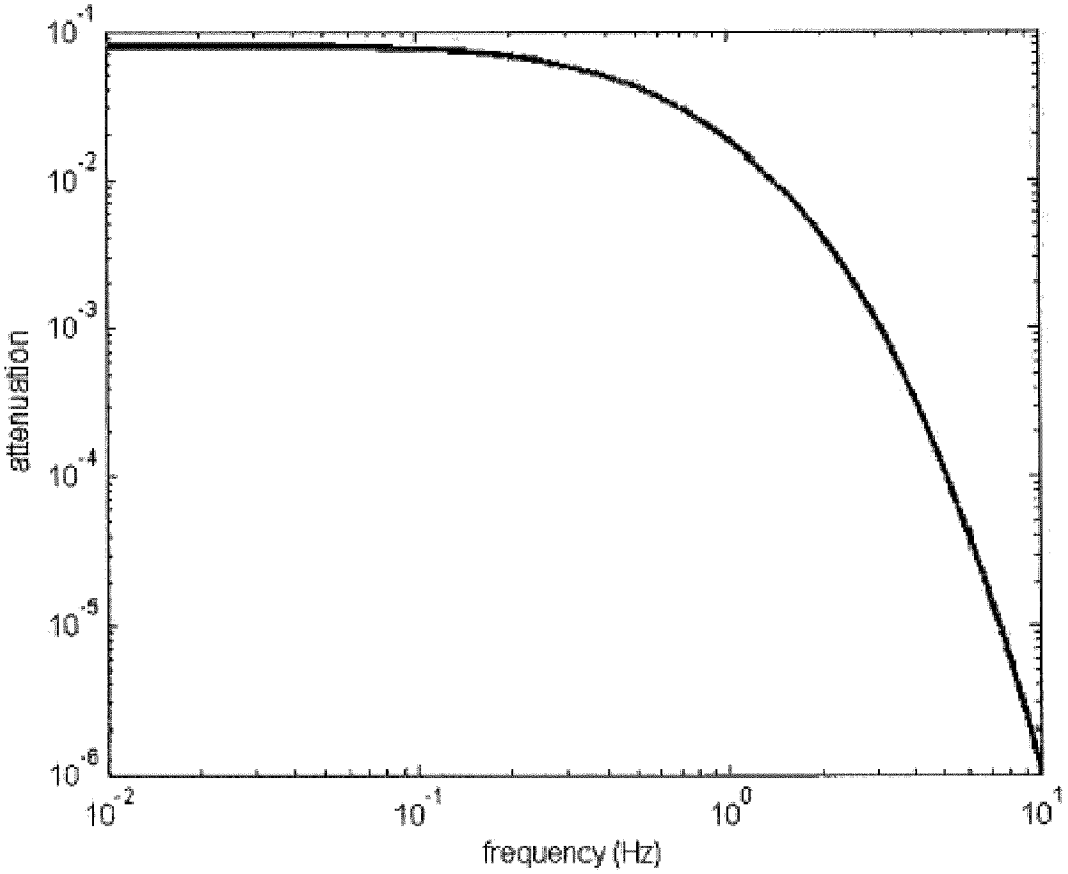
FIG. 9 is an attenuation-to-EM signal frequency graph of a shallow and/or high resistivity Earth formation.
Figure 10:
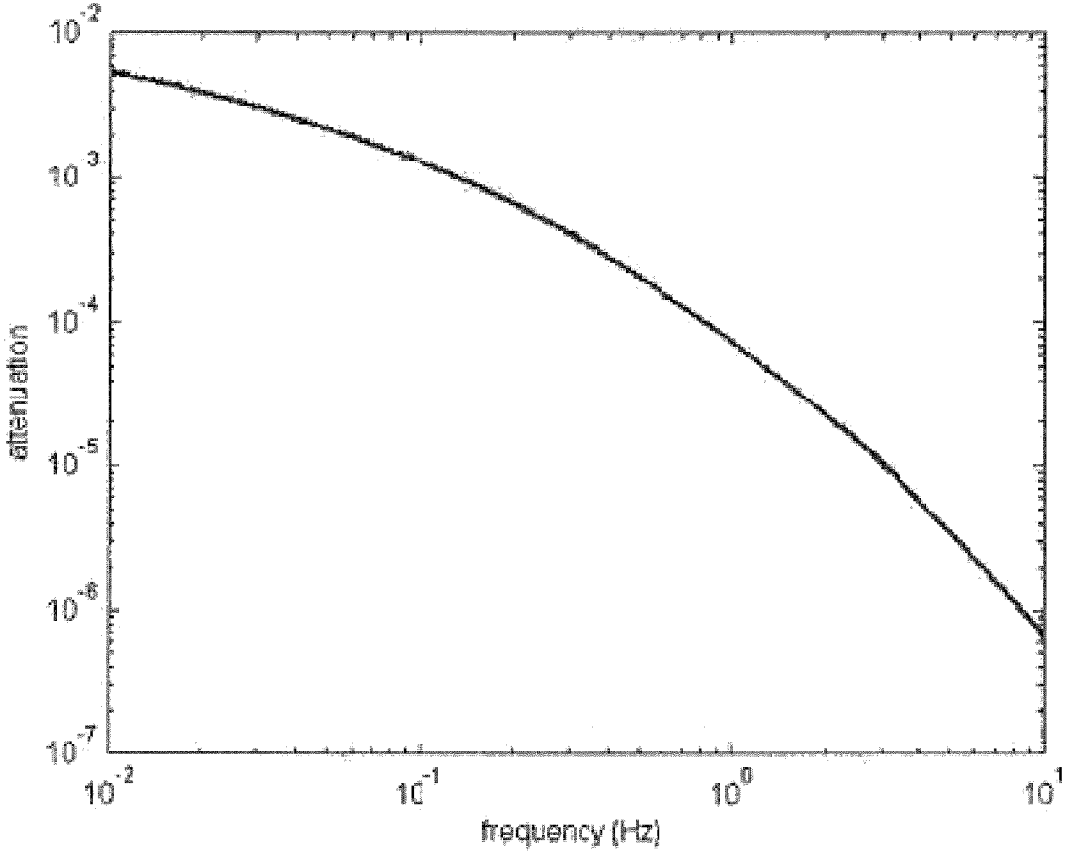
FIG. 10 is an attenuation-to-EM signal frequency graph of a deep and/or low resistivity Earth formation.

The selection of the EM downlink transmission frequency will depend in part on the attenuation properties of the Earth formation between the surface communications equipment 13 and the downhole telemetry tool 45. In shallow and/or high resistivity formations, the Earth's attenuation is relatively flat for EM signals in a low frequency range, as can be seen in FIG. 9, and thus there is a wider range of suitable frequencies that can be selected for the EM downlink transmission. In deeper and/or low resistivity formations, the Earth's attenuation of an EM signal will increase more significantly with an increase in frequency, as can be seen in FIG. 10, and thus it is more imperative that a lower frequency be selected to minimize the attenuation effects of the Earth formation. At these frequencies, it is expected to take 10-20 seconds to transmit each bit of data; there is expected to be less attenuation in deep/conductive formations when EM signals are transmitted in the ultra-low frequency range as compared to transmissions in higher frequency ranges, e.g. from 0.5 to 12 Hz. Also, the extra time per bit is expected to increase decoding strength linearly.

Figure 11:
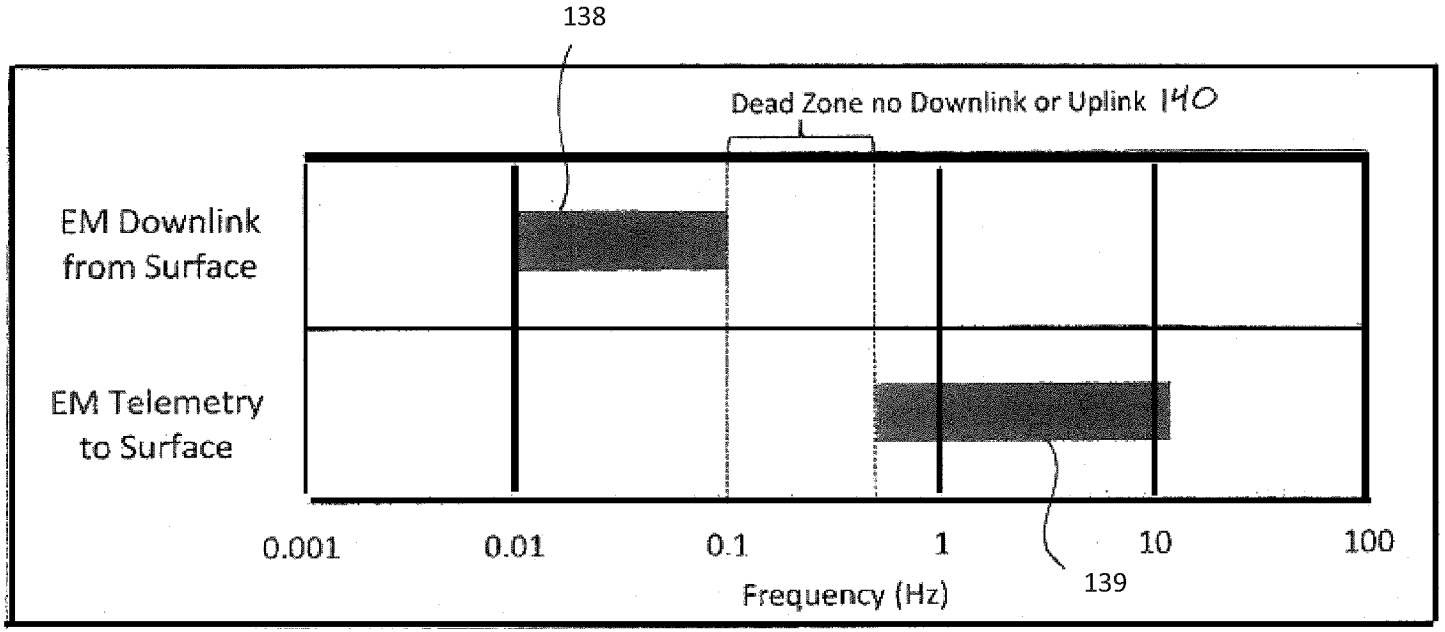
FIG. 11 is a chart of suitable EM uplink and downlink frequencies for the wireless communications system.

Referring to FIG. 11, the wireless communications system is configured to ensure that the EM uplink and downlink transmission frequencies do not overlap. In one embodiment, the EM downlink transmissions have a selected frequency range 138 of 0.01 to 0.1 Hz, and the EM uplink transmissions have a selected frequency range 139 of 0.5 Hz to 12 Hz. A "dead zone" 140 of no downlink or uplink transmissions is thus defined between 0.1 Hz and 0.5 Hz; this dead zone 140 assists in filtering and recognition of the EM signals when EM uplink and downlink signals are being sent at the same time. In particular, the system can be configured so that the EM uplink frequency is at least tenfold higher than the EM downlink frequency.

Figure 12:
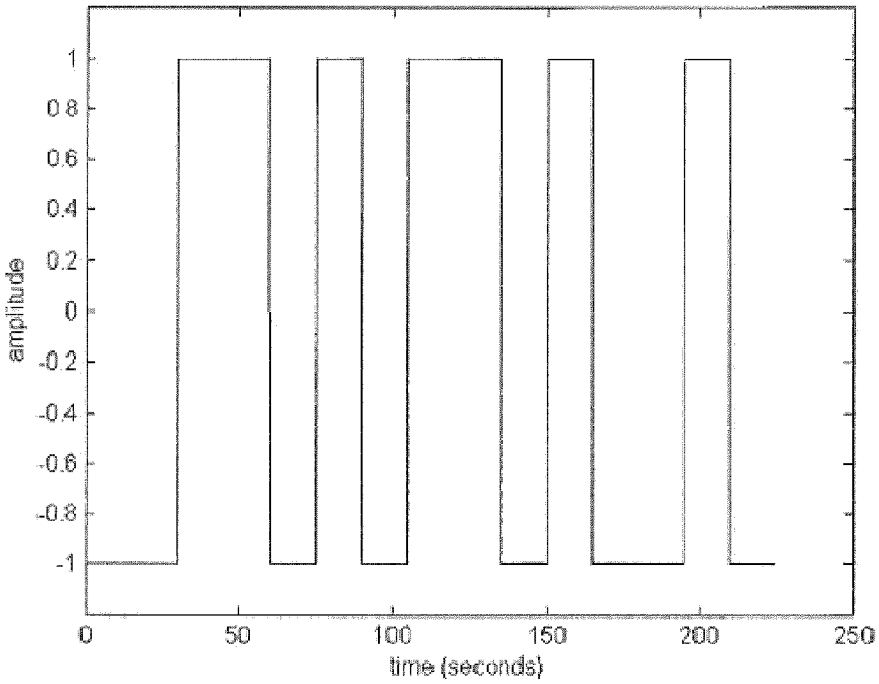
FIG. 12 is a graph of an EM downlink transmission waveform according to one embodiment.
Figure 13A:
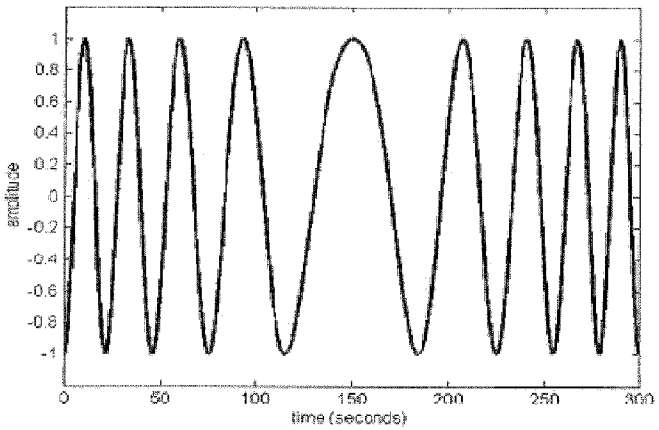
FIGS. 13(*a*) and 13(*b*) are graphs of a first and second chirp waveforms representing first and second binary data bits used to encode an EM downlink transmission according to an alternative embodiment.
Figure 13B:
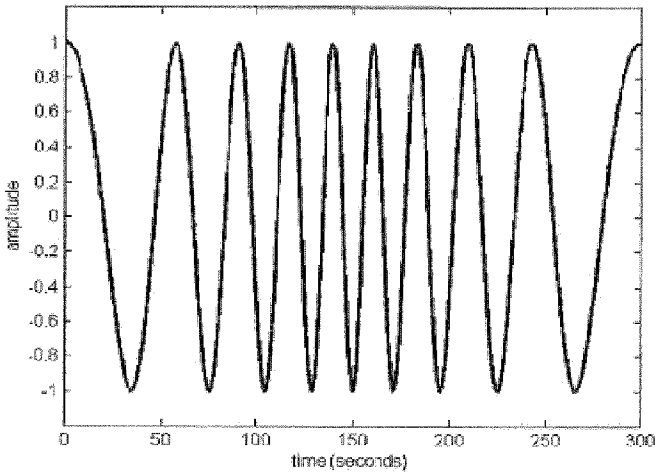
Figure 13C:
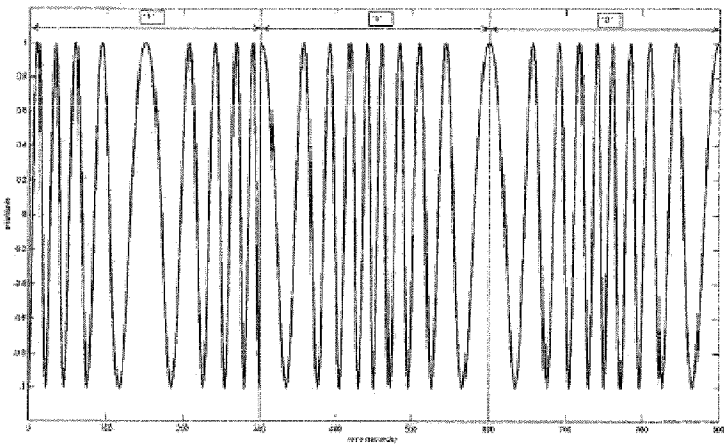
Figure 13D:
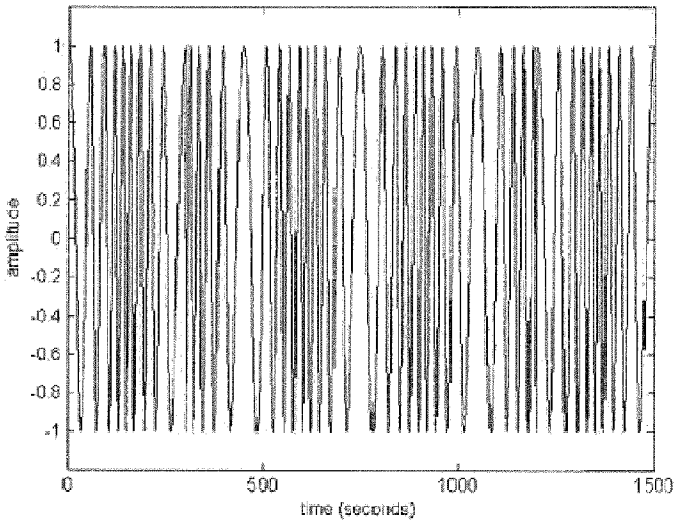

In one embodiment and as shown in FIG. 12, the generated EM signal is a single channel square waveform with an ultra-low frequency of 0.01 Hz, a voltage of 24 V and a current of 100 mA. The square waveform has negative and positive polarities with a short gap (not shown) in between the positive and negative square waves to prevent shorting the H-bridge circuit 124. In an alternative embodiment, the EM signal comprises positive or negative pulses of the same frequency, voltage and current ranges as the square wave EM signal. In yet another embodiment, the EM signal comprises a sinusoidal carrier waveform of the same frequency, voltage and current ranges as the square waveform EM signal.

When the EM downlink transmission has an ultra-low frequency square waveform, it will have relatively long pulse widths in the order of 10-30 seconds. Practical considerations such as operating conditions and operator preferences can limit the maximum time window the system is permitted to send a downlink message. In this embodiment, the system is programmed to limit each downlink message to a maximum time window of 5 minutes. When transmitting at a frequency within the ultra low frequency range, one bit can be transmitted in approximately 10-20 seconds. This data transfer rate defines the maximum amount of data in the downlink message, which for a 5 minute limit is 15-30 bits. In some cases, an operator may prefer each downlink message to be limited to about 2-3 minutes, which further limits the amount of data that can be transmitted per downlink message.

Because of the limited amount of data that can be transmitted in each EM downlink transmission, the downlink message contained in the transmission is necessarily short. Each downlink message has a structure comprising a fixed header, a short pause, and then a data packet containing the contents of the message. The fixed header serves to establish the detection, timing, and amplitude of the downlink message, and in effect enables the downhole telemetry tool 45 to recognize that the EM transmission contains a downlink message. The short pause is provided to ensure that the downhole telemetry tool 45 can clearly determine the end of the fixed header and the beginning of the data packet. The data packet contains three sections: a data ID, the message, and error detection and correction bits (CRC). The data ID section serves to identify the type of change to make in the downhole telemetry tool 45 by a command instruction in the downlink message. For example, the data ID section can comprise one of the following three bit commands:

"000" change transmission current setting
"001" change transmission voltage setting
"010" change transmission frequency
"011" change transmission coding type
"100" change cycles per bit
"101" change configuration file
"110" change mud pulse coding type (if applicable)
"111" change mud pulse frequency (if applicable)

The message section contains the specific settings for the change. The CRC serves to confirm whether the message and the data ID sections are properly decoded and provides information for certain error correction methods to be performed if the decoding was not successful.

As noted above, when the downhole telemetry tool 45 receives an EM downlink transmission, the EM downlink control module 34(*a*) will apply filtering and signal processing to the received transmission, then execute decoder program code containing a demodulation technique(s) corresponding to the selected modulation technique(s) used by the surface operator to encode the downlink message into the EM downlink transmission. The decoder program code uses this demodulation technique to decode the EM downlink transmission carrier waves and extract the bitstream containing the downlink message.

Optionally, the downhole telemetry tool 45 is programmed to transmit a confirmation signal back to the surface to acknowledge receipt of the command instruction. The data packet of the downlink message allocates one bit for a "confirmation requested flag" command, wherein a "0" flag means no confirmation is to be sent, and a "1" flag means that the downhole telemetry tool 45 is to send a confirmation signal. When the EM downlink control module 34(*a*) decodes the EM downlink transmission and extracts this command, the command will be relayed via the communications bus 40 to the EM uplink control module 34(*b*) to encode a unique "status frame" representing the confirmation signal into an EM uplink transmission, which would then be transmitted by the EM communications unit 13 to the surface.

The status frame can include a short message that indicates that a downlink message has been received by the downhole telemetry tool 45. Alternatively, the uplink control module 34(*b*) can encode the entire downlink message and re-transmit it back to the surface as the confirmation signal. Such "ping back" of the entire downlink message can be used to confirm receipt of certain high priority commands. In this alternative embodiment, the data packet of the downlink message can allocate two bits for the confirmation requested flag command to include a command to send back a confirmation signal containing the entire downlink message.

Alternate Embodiment—EM transmissions Using Chirps

Instead of transmitting the EM downlink transmission as a square wave signal, sinusoidal carrier wave signal, or pulsed signal, the EM downlink transmission can be in the form of a chirp signal, otherwise known as a sweep signal. A chirp signal can be an up-chirp in which the frequency increases with time, or a down-chirp in which the frequency decreases with time, or comprise a combination of up-chirps and down-chirps. Using chirps to transmit the EM downlink transmission can be advantageous when there are narrow baud interferences at the drill site, such as interferences from nearby equipment at the drill site. It is also theorized that under certain circumstances, such as longer depths and higher Earth formation attenuations, chirps can provide better EM signal transmission performance over carrier wave or pulse signals.

The principles of encoding and decoding downlink messages into and from chirp signals are similar to the principles used in spread spectrum communications. Chirp modulation techniques known in the art can be used, such as linear frequency modulation which uses sinusoidal waveforms whose instantaneous frequency increases or decreases linearly over time. Binary data can be modulated into chirps by mapping the bits into chirps of different chirp patterns, such as an up-chirp and a down-chirp, or a fast-slow-fast chirp and a slow-fast-slow chirp. The frequency range for the chirps in an EM downlink transmission is preferably in an ultra low frequency range between 0.01 to 0.1 Hz, and the voltage and current levels are selected to ensure that the EM transmission is within the intrinsically safe zone. As noted above, the attenuation characteristics of the Earth formation between the surface communications equipment 18 and the downhole telemetry tool 45 will have a factor in the selection of a suitable frequency range for the chirps. In the example shown in FIGS. 13(*a*) and 13(*b*), two different chirps having a frequency range of 0.01 to 0.03 to 0.01 Hz and 0.03 to 0.01 to 0.03 Hz respectively and each represent a different bit in a binary bit symbol set. More particularly, FIG. 13(*a*) shows a first chirp that varies from fast to slow to fast and which represents a "1" bit, and FIG. 13(*b*) shows a second chirp that varies from slow to fast to slow and which represents a "0" bit. Alternatively (not shown), a "1" bit can be represented by a down-chirp, and a "0" bit can be represented as an up-chirp.

Figure 14:
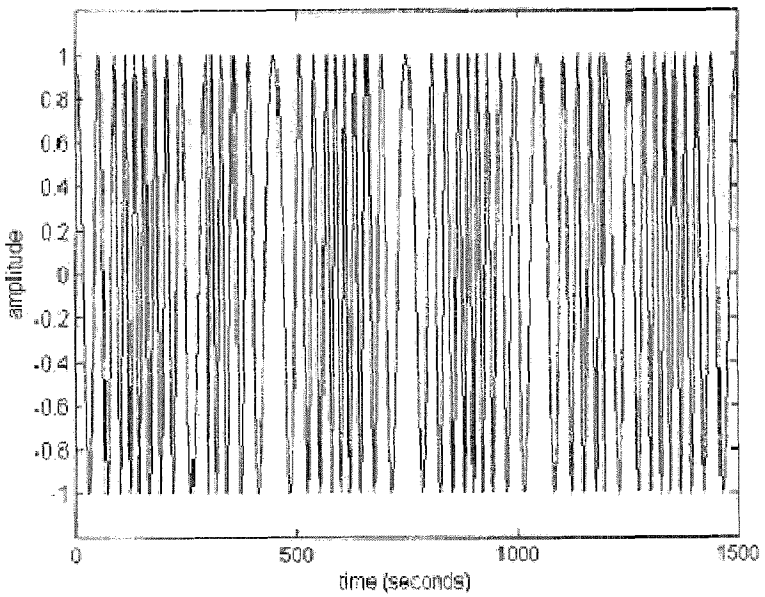
FIG. 14 is a graph of an EM downlink transmission having a downlink message encoded as a series of chirp waveforms shown in FIGS. 13(*a*) to (*d*).

A multiple bit symbol set can be encoded using chirp waveforms, by grouping the first and second bits together; for example, a three bit symbol can be represented by the grouping of chirp waveforms shown in FIG. 13(*c*), and a five bit symbol can be represented by the grouping of chirp waveforms shown in FIG. 13(*d*). FIG. 14 shows an EM transmission carrying a downlink message encoded into chirp waveforms using the binary bits shown in FIGS. 10(*a*) to (*d*).

The downhole telemetry tool 45 programming can be modified to decode EM transmissions comprising chirps in a manner known in the art. The downhole telemetry tool 45 programming can also be modified to encode telemetry and other data into an EM uplink transmission comprising chirps; such EM uplink transmissions would be transmitted at a non-overlapping higher frequency range than the EM downlink transmissions, e.g. 1-3 Hz.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of the general concept.

What is claimed is:

1. A wireless communications system for a downhole drilling operation, comprising:

(a) surface communications equipment comprising a surface electromagnetic (EM) communications module with an EM downlink transmitter configured to transmit an EM downlink transmission at a frequency between 0.01 Hz and 0.1 Hz, and an EM uplink receiver configured to receive an EM uplink transmission; and (b) a downhole telemetry tool mountable to a drill string and having a downhole EM communications unit with an EM downlink receiver configured to receive the EM downlink transmission, and an EM uplink transmitter configured to transmit the EM uplink transmission at a frequency that is higher than the EM downlink transmission frequency;

wherein the EM downlink transmission contains an encoded downlink message having a structure comprising in sequential order: a fixed header, a pause, and a data packet.

2. A wireless communications system as claimed in claim 1 wherein the data packet comprises a data ID containing a type of change to make in the downhole telemetry tool, message content containing settings for the type of change, and error and correction bits.

3. A wireless communications system as claimed in claim 2 wherein the data packet contains a confirmation requested flag command, and the downhole telemetry tool comprises a processor and a memory having encoded thereon program code executable by the processor to decode the EM downlink transmission and transmit the EM uplink transmission comprising a confirmation message when the decoded EM downlink transmission contains the confirmation requested flag command.

4. A wireless communications system as claimed in claim 3 wherein the confirmation message comprises the downlink message.

5. A wireless communications system as claimed in claim 1 wherein the surface EM downlink transmitter is further configured to transmit the EM downlink transmission at a voltage and current that is below ignition energies for hazardous gases at the drilling operation.

6. A wireless communications system as claimed in claim 1 wherein the voltage and current of the EM downlink transmission is within an intrinsically safe zone for a hazardous gas environment.

7. A wireless communications system as claimed in claim 1 wherein the surface EM downlink transmitter is configured to generate the EM downlink transmission in the form of a square wave signal, or a pulsed signal, or a sinusoidal carrier wave signal.

8. A wireless communications system as claimed in claim 1 wherein the surface EM downlink transmitter is configured to generate the EM downlink transmission in the form of chirp signal.

9. A wireless communications system as claimed in claim 8 wherein the surface communications equipment further comprises a computer having a processor with a memory having encoded thereon an EM signal modulation program code executable by the processor to encode a downlink message into the chirp signal.

10. A wireless communications system as claimed in claim 9 wherein the EM signal modulation program code comprises a binary symbol set wherein a first bit is represented by an up-chirp and a second bit is represented by a down-chirp.

11. A wireless communications system as claimed in claim 9 wherein the EM signal modulation program code comprises a binary symbol set wherein a first bit is represented by a fast-slow-fast chirp and a second bit is represented by a slow-fast-slow chirp.

12. A wireless communications system as claimed in claim 10 wherein the EM signal modulation program code comprises a three or five bit symbol set wherein each symbol comprises a group of the first and second bits.

13. A wireless communications system as claimed in claim 1 wherein the EM uplink transmitter is configured to transmit an EM uplink transmission at a frequency greater than 0.5 Hz.

14. A wireless communications system as claimed in claim 13 wherein the downhole EM uplink transmitter is configured to transmit the EM uplink transmission at a frequency that is at least ten times higher than the EM downlink transmission frequency.

15. A method for communicating between surface communications equipment and a downhole telemetry tool in a downhole drilling operation, comprising:

(a) transmitting an electromagnetic (EM) downlink transmission at a frequency between 0.01 Hz and 0.1 Hz using a surface EM communications module with an EM downlink transmitter;

(b) configuring a downhole EM communications unit with an EM downlink receiver to receive the EM downlink transmission at the transmitted frequency;

(c) transmitting an EM uplink transmission at a frequency that is higher than the EM downlink transmission frequency, using an EM uplink transmitter of the downhole EM communications unit, and (d) configuring an EM uplink receiver of the surface EM communications module to receive the EM uplink transmission at the transmitted frequency;

wherein the EM communications module is part of surface communications equipment and the downhole EM communications unit is part of a downhole telemetry tool mounted to a drill string; and wherein the EM downlink transmission contains an encoded downlink message having a structure comprising in sequential order: a fixed header, a pause, and a data packet.

16. A method as claimed in claim 15 wherein the data packet comprises a data ID containing a type of change to make in the downhole telemetry tool, message content containing settings for the type of change, and error and correction bits.

17. A method as claimed in claim 16 wherein the data packet contains a confirmation requested flag command, and the method further comprises at the downhole EM communications unit: decoding the EM downlink transmission and transmitting the EM uplink transmission comprising a confirmation message when the decoded EM downlink transmission contains the confirmation requested flag command.

18. A method as claimed in claim 17 wherein the confirmation message comprises the downlink message.

19. A method as claimed in claim 15 wherein the EM uplink transmission is transmitted at a frequency greater than 0.5 Hz.

20. A method as claimed in claim 19 wherein the EM uplink transmission is transmitted at a frequency that is at least ten times higher than the EM downlink transmission frequency.

21. A method as claimed in claim 15 further comprising transmitting the EM downlink transmission at a voltage and current that is below ignition energies for hazardous gases at the drilling operation.

22. A method as claimed in claim 15 further comprising transmitting the EM downlink transmission in the form of a square wave signal, or a pulsed signal, or a sinusoidal carrier wave signal.

23. A method as claimed in claim 15 further comprising transmitting the EM downlink transmission in the form of chirp signal.

* * * * *